US007156571B2

(12) United States Patent
Mook et al.

(10) Patent No.: US 7,156,571 B2
(45) Date of Patent: Jan. 2, 2007

(54) COMBINATION PEN OR PENCIL AND CIRCULAR MARKING IMPLEMENT

(76) Inventors: Josephine A. Mook, 4226 Winchester Rd., Erie, PA (US) 16506; James Gwinn, 6119 Sterretania Rd., Fairview, PA (US) 16415

( * ) Notice: Subject to any disclaimer, the term of this patent is extended or adjusted under 35 U.S.C. 154(b) by 115 days.

(21) Appl. No.: 11/037,582

(22) Filed: Jan. 13, 2005

(65) Prior Publication Data

US 2006/0153626 A1 Jul. 13, 2006

(51) Int. Cl.
*B43K 27/00* (2006.01)

(52) U.S. Cl. ..... 401/29; 401/31; 401/195; 401/18

(58) Field of Classification Search ..... 401/29–35, 401/18–20, 195
See application file for complete search history.

(56) References Cited

U.S. PATENT DOCUMENTS 2,591,027 A * 4/1952 Nunez ..... 401/19
3,079,894 A * 3/1963 Johmann ..... 401/31
3,336,909 A * 8/1967 Diamond ..... 401/26
4,410,290 A * 10/1983 Ito et al. ..... 401/196
4,580,918 A * 4/1986 Baker et al. ..... 401/29
5,067,837 A 11/1991 Panopoulos
6,155,733 A 12/2000 Holbrook
6,213,661 B1 4/2001 Coon
6,481,908 B1 11/2002 Lychwick

FOREIGN PATENT DOCUMENTS

WO WO 91/00810 1/1991

* cited by examiner

*Primary Examiner*—Khoa D. Huynh
(74) *Attorney, Agent, or Firm*—Wayne L. Lovercheck

(57) ABSTRACT

A combination pen, pencil and circular marking implement that can be utilized as a pen or pencil writing tool and for circular ink marking on printed surfaces for word game and puzzle solution includes a central passageway for accommodating ink cartridges or lead pencil cartridges encompassed by an ink reservoir that communicates with a cylindrical marking die for circling numbers and letters, and the marking die capable of advancement or retraction by rotation of a tool gripping collar attached to the body of the combination writing and marking implement whereupon rotation of the tool gripping collar engages internal cams for actuating the advancement and retraction of the marking die so that either the pen/pencil writing function or the circular ink marking function can be selected for use.

15 Claims, 6 Drawing Sheets

COMBINATION PEN OR PENCIL AND CIRCULAR MARKING IMPLEMENT

FIELD OF THE INVENTION

The present invention pertains to multi-function writing implements, and more particularly pertains to a multi-function writing tool that includes pen and pencil writing capabilities and a circular ink marking capability for assisting an individual engaged in alphanumeric puzzle and word game solving.

BACKGROUND OF THE INVENTION

The field of writing tools and implements has grown to the extent that there now are writing and marking tools and implements for numerous individual and stylized uses. Thus, ballpoint pens with replaceable tips and cartridges, and in a variety of ink colors, are common in homes and offices. The replaceable tips also provide the user with various style of line width from fine point to broad point. The writing tips can be retractable or non-retractable and either ballpoint or roller ball.

Felt tip pens intended for artwork and marker and highlighting are also common, and now come in colors that range across the spectrum; the writing tips are generally larger and wider than the ink pen tips in order to make the distinctive and easily discernible color highlighting or marking lines on, for example, books, posters, signs and artwork. The ink for the marking pens can be permanent, dry erase or wet erase. In addition, marker pens now come in liquid ink in a range of fluorescent colors.

Another type of specialized writing implement is the mechanical pencil used by draftsmen, architects, illustrators, surveyors, etc., that employs a simple twisting or pushing action on the body, or a portion of the pencil body, to advance and retract the lead. Many types of mechanical pencils include refillable cartridges that are stacked and stored within the pencil body. Moreover, the bodies of the above-described writing tools can include rubber grips for enhancing the writing comfort of the user.

One of the most common uses for writing tools and implements is in assisting the individual in solving alphanumeric puzzles that can include crossword puzzles, anagrams, rebuses, word scrambles and word searches wherein the writing tool is used to cross off or encircle the letters and words of the particular puzzle as they are disclosed or uncovered. However, depending on the type of writing tool used, crossing out the letters or words can completely obscure them causing the individual to lose track of which letters and words have been used or discovered. In addition, crossing off or blotting out the letters and words tends to clutter up the puzzle making it more difficult to discern correct letter and word combinations.

Thus, the prior art discloses a variety of writing tools and implements that incorporate pen, pencil or felt tip marker nibs for both fine and broad line writing, marking and highlighting, and also specially designed ends for marking and scoring certain types of printed surfaces.

For example, the Carlson patent (PCT patent WO 91/00810) discloses a dual tip marking and writing implement that includes a fine line-marking nib coaxially disposed within the nib aperture of a marking nib. The fine line-writing nib is retractable within the nib aperture so that the implement can be used as a conventional highlighting marker, and when the fine line-marking nib is projected past the nib aperture, the implement functions as a traditional protract-retract ink pen.

The Panopoulos patent (U.S. Pat. No. 5,067,837) discloses a variable point writing instrument wherein the writing tip is selectively expandable between a smallest diametric dimension and a largest diametric dimension.

The Coon patent (U.S. Pat. No. 6,213,661 B1) discloses a retractable felt-tipped pen and includes a flexible membrane disposed between movable cylindrical members one of which has a pen nib connected thereto. The flexible membrane is rotatable for sealing and exposing the pen nib as desired by the user.

The Holbrook et al. patent (U.S. Pat. No. 6,155,733) discloses an adjustable multi-tip marker for producing distinctive outlining or highlighting effects, and includes at least a pair of slidable, retractable tips disposed beside a fixed tip with all the tips being encased within the hollow body of the writing implement.

The Lychwick patent (U.S. Pat. No. 6,481,908 B2) discloses a multi-function marking pencil that has the ability to fill in score spaces on standardized tests, such as scholastic aptitude tests, and to remove the cover layer from cards, such as lottery cards.

Nonetheless, despite the ingenuity of the above devices, there remains the need for a writing implement that can provide both pen and pencil writing functions in combination with a circular marking function for marking printed surfaces representing various types of alphanumeric puzzles and word games as part of their solution.

SUMMARY OF THE INVENTION

The present invention comprehends a combination pen or pencil and circular marking tool or implement that includes both standard pen or pencil writing capabilities and a circular ink marking function. The combination writing and circular marking implement includes an elongated implement body having an eraser and cap mounted at a first end and an opposite second writing and circular marking end. A tool-gripping collar extends in axial alignment from the implement body and is rotatable by the user for selecting either the pen/pencil writing function or the circular ink marking function. A cylindrical collar tip closure cone is attached to the tool-gripping collar adjacent the second writing and marking end. A cylindrical marking die cartridge nests within the tool-gripping collar for axial advancement and retraction concomitant with the rotation of the tool-gripping collar whereupon a circular ink marking die mounted to the marking die cartridge is extended for use or retracted for employing the pen/pencil function. The marking die communicates with an ink reservoir so that ink is wicked from the reservoir to the marking die for making circular ink marks around the letters and numbers of word games and puzzles arranged on the printed surface. A passageway extends from the first end of the implement body through the ink reservoir and within which pencil leads or ink cartridges can be disposed for employing the combination implement as a pen or pencil writing tool. A pair of cylindrical cams, one of which is mounted to the tool gripping collar and the other being attached to the marking die cartridge, facilitate the advancement or retraction of the circular marking die tip by their rotational engagement or disengagement to and from each other concomitant with the rotation of the tool gripping collar. Thus, the primary action the user has to take to utilize the various writing and marking tips is the rotation of the tool-gripping collar. Alternative embodiments showing other ways to facilitate the advancement or retraction of the circular marking die, or the selection between the pen/pencil and circular marking functions are shown.

It is an objective of the present invention to provide a combination pen or pencil and circular marking implement that is of particular use to individuals solving crossword puzzles, anagrams, word scrambles, word searches and like alphanumeric puzzles found, for example, in newspapers, magazines and puzzle books.

It is another objective of the present invention to provide a combination pen or pencil and circular marking implement that has the capability to function as both a ball point ink pen or a mechanical lead pencil with consumable and replaceable marking leads and a circular marking implement.

It is a further objective of the present invention to provide a combination pen or pencil and circular marking implement that includes a circular marking die capable of making ink circles around letters, numbers and other indicia arranged on a printed paper or cardboard surface.

It is still yet another objective of the present invention to provide a combination pen or pencil and circular marking implement that includes the capability to selectively and coincidently advance and withdraw the circular marking die and the pen/pencil tip so that when the circular die is being used the pen/pencil tip is retracted and then the obverse.

Still yet another objective of the present invention is to provide a combination pen or pencil and circular marking implement that facilitates the swift, distinct and unambiguous circling of numbers and letters of an alphanumeric puzzle by the individual engaged in puzzle solution.

A still yet further objective of the present invention is to provide a combination pen or pencil and circular marking implement that is simple in construction and easy to operate and use.

These and other objects, features and advantages will become apparent to one skilled in the art upon a perusal of the following detailed description read in conjunction with the accompanying drawing figures.

DETAILED DESCRIPTION OF THE PREFERRED EMBODIMENT

Figure 1:
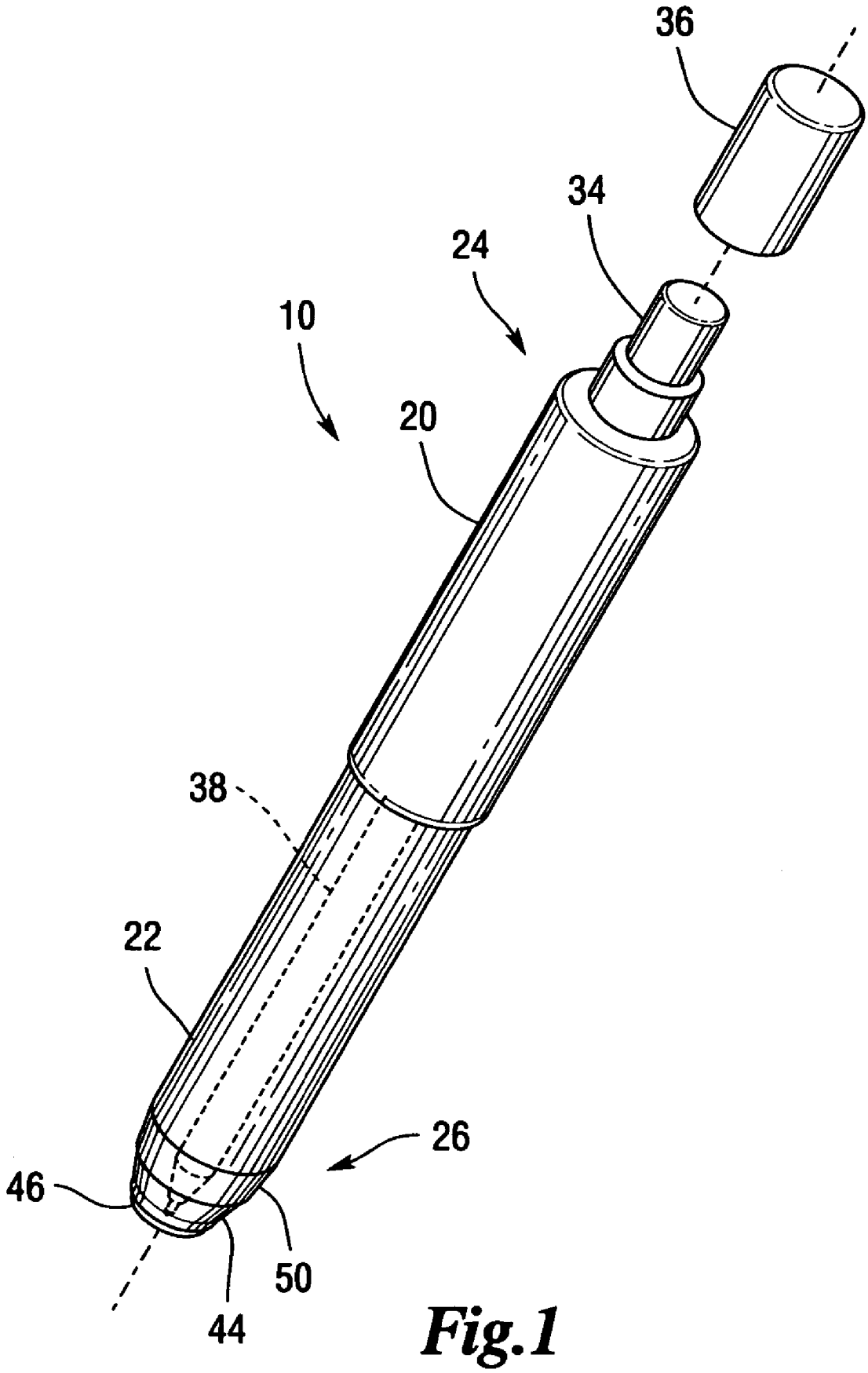
FIG. 1 is a perspective view of the combination pen or pencil and circular marking implement of the present invention.
Figure 2:
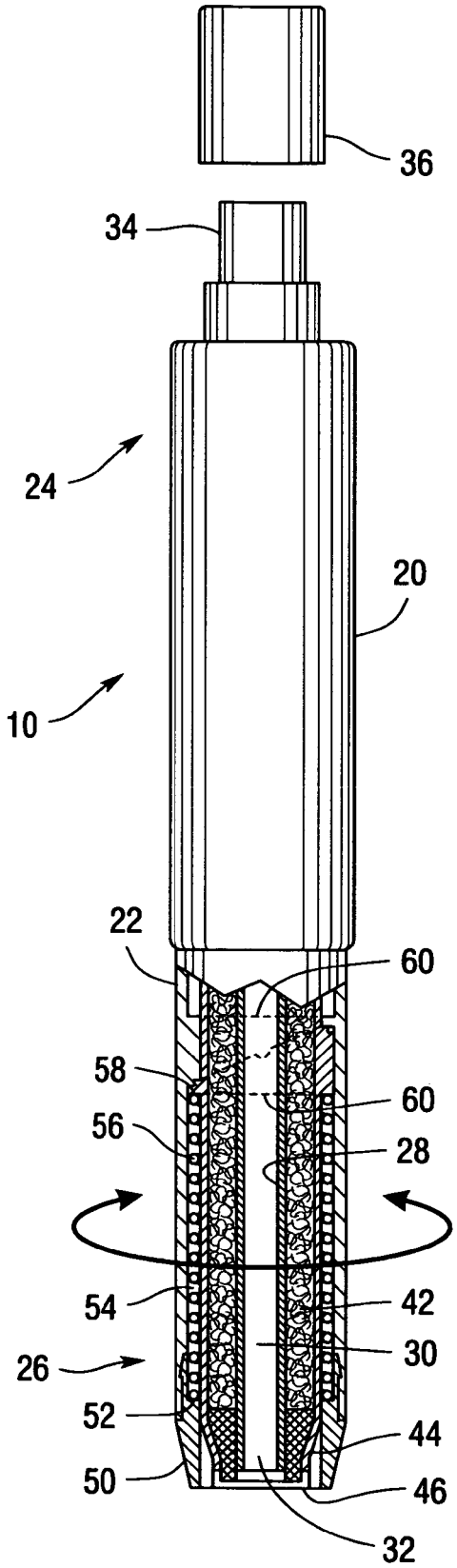
FIG. 2 is a side elevational view shown in partial section of the combination pen or pencil and circular marking implement of the present invention illustrating the retraction of the circular die marking tip so that the pen or pencil tip can be utilized.
Figure 3:
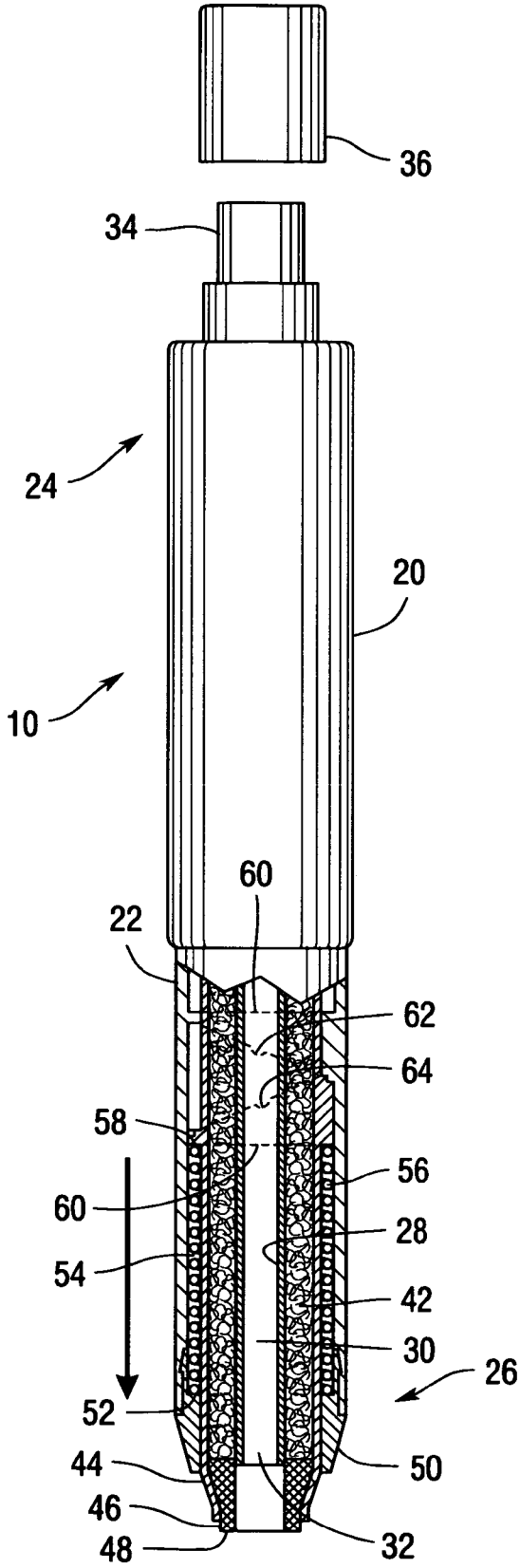
FIG. 3 is a side elevational view shown in partial section of the combination pen or pencil and circular marking implement illustrating the advancement of the circular marking die for making circular marks on a printed surface.
Figure 4:
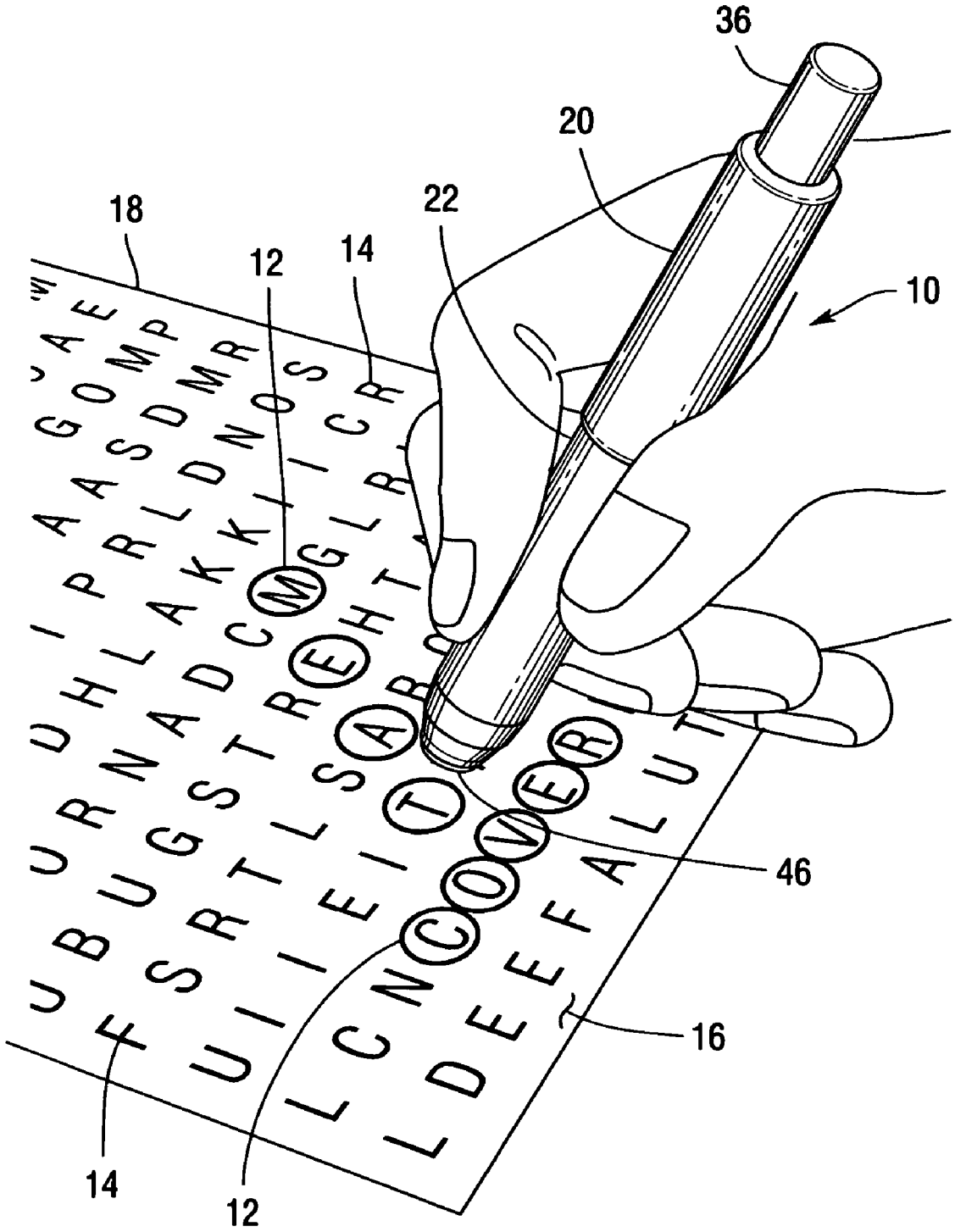
FIG. 4 is a perspective view of the combination pen or pencil and circular marking implement of the present invention illustrating the marking die making circles around letters in an alphanumeric puzzle as part of the process of solving the puzzle.

Illustrated in FIGS. 1–6 is a combination pen or pencil and circular marking implement 10 for writing in pen or pencil and also for making ink (or pencil) circles 12 around indicia 14 and symbols such as numbers and letters arranged on a printed surface 16 and which form any of a variety of alphanumeric puzzles 18 such as crossword puzzles, anagrams, rebuses, word scrambles and word searches that are commonly found in newspapers, magazines and puzzle books. A representative puzzle 18 in the form of a word scramble is shown in FIG. 4 wherein letters are distributed and arranged on the printed surface 16 in such a way as to form words that are hidden by the ostensible random arrangement of the letters. As each successive letter for a given word is picked out, that letter is circled in ink with the implement 10 of the present invention until all the letters for that word are circled. The individual will then proceed to pick out other words until the entire arrangement of letters are circled indicating that the word scramble has been solved. By encircling the letters and numbers in this manner progress in the solution of the puzzle can be monitored so that the individual knows which numbers and letters have been used and which remain to form words.

As shown in FIGS. 1–6, the writing implement 10 includes a cylindrical elongated implement body 20 and a cylindrical tool gripping collar 22 that is attached to the body 20 and is in axial alignment therewith. The tool gripping collar 22 is selectively manually rotatable relative to the implement body 20 for allowing the user to select the desired function, i.e., writing in pen or pencil or making circular ink marks 12 as shall be hereinafter further described. A first end 24 and an opposite second writing and marking end 26 further define the writing implement 10. Extending through both the body 20 and the tool gripping collar 22 is an inner barrel or tube 28 that defines a passageway 30 concentric with the body 20 and the tool gripping collar 22. The passageway 30 terminates at a tip aperture 32 adjacent the second end 26 of the writing implement 10.

Figure 5:
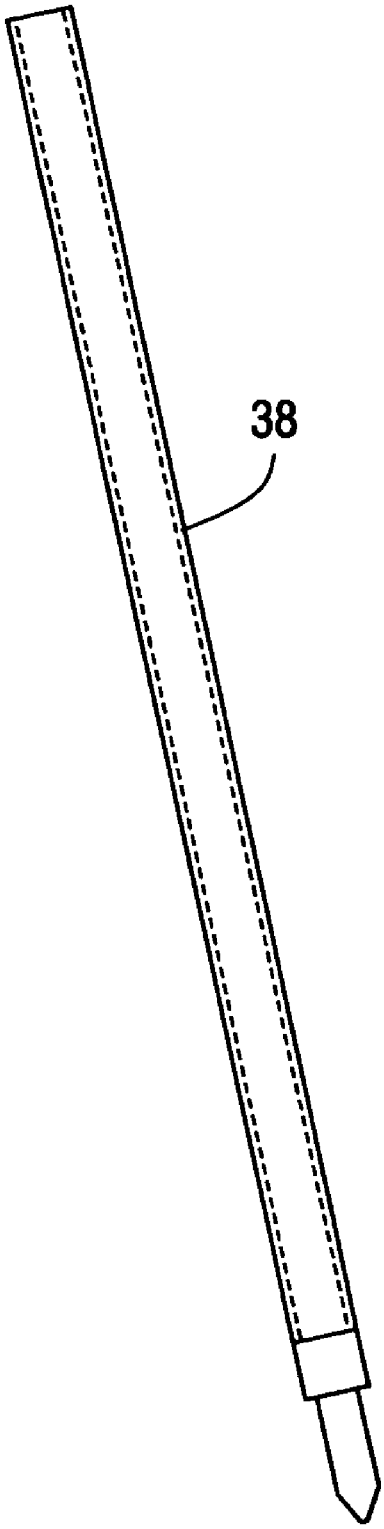
FIG. 5 is a side elevational view of the combination pen or pencil and circular marking implement of the present invention illustrating an ink cartridge for disposition within the passageway of the writing implement.
Figure 6:
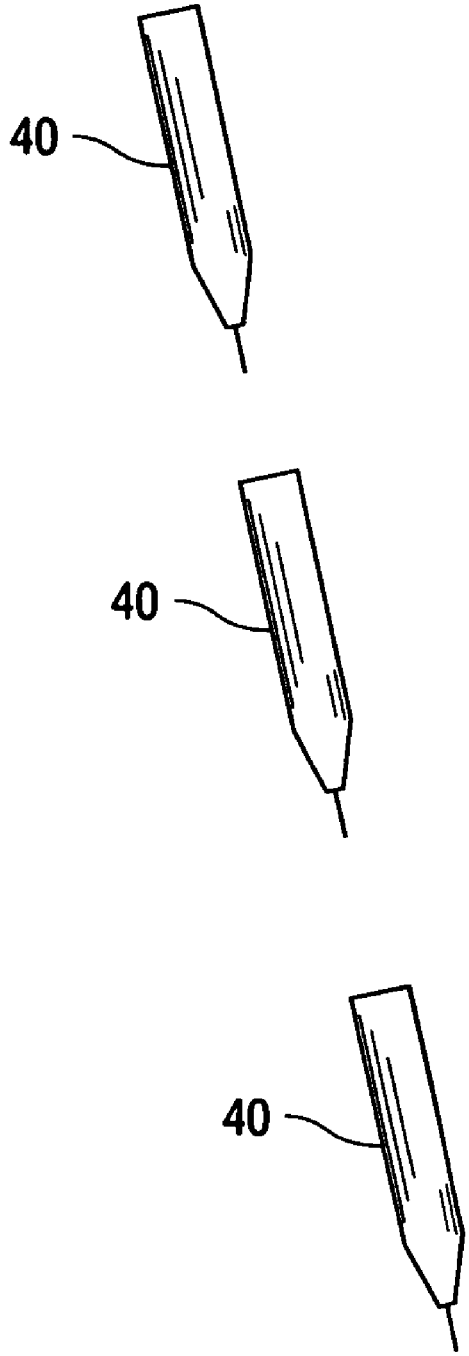
FIG. 6 is a side elevational view of the combination pen or pencil and circular marking implement of the present invention illustrating a pencil cartridge for disposition within the passageway of the writing implement.

As shown in FIGS. 1–4, the writing implement 10 includes an eraser 34 removably attachable to the body 20 at the first end 24 thereof. A cap or lid 36 is used to cover and uncover the eraser 34. In one embodiment the eraser 34 can be depressed to advance ink or lead pencil cartridges, such as replaceable and consumable mechanical lead pencil cartridges, through the passageway 30 and the tip aperture 32 so that the writing implement 10 can be used to write in pen or pencil. A representative ink pen cartridge 38 is shown in FIG. 5 and a representative lead pencil cartridge 40 is shown in FIG. 6 either of which can be selectively disposed within the passageway 30 of the writing implement 10. For illustrative purposes the ink pen cartridge 38 is shown disposed in the passageway 30 of the writing implement 10 in FIG. 1.

Illustrated in FIGS. 2 and 3 is an ink reservoir 42 disposed circumjacent the inner barrel 28 and the passageway 30 and concentric with the inner barrel 28 and the passageway 30. Encircling the ink reservoir 42 adjacent the second writing and marking end 26 is a cylindrical marking die cartridge 44. The marking die cartridge 44 is also nested within the tool gripping collar 22 and is interconnected therewith so that the selective rotation of the tool gripping collar 22 actuates the slidable linear movement of the marking die cartridge 44 as will be hereinafter further described. Mounted to the marking die cartridge 44 at the second end 26 of the implement body 20 is a circular marking die 46. The circular marking die 46 is mounted inboard of the marking die cartridge 44 and encircles the tip aperture 32 of the passageway 30. The marking die 46 is porous and is in flow communication with the ink reservoir 42 so that the marking die 46 can wick ink held within the ink reservoir 42, similar to the wicking action common in felt tip markers, to the face 48 of the marking die 46 for making ink circles 12 around indicia 14, such as the letters and numbers of the word puzzle 18 of FIG. 4.

Located at the second end 26 of the implement body 10, and attached to the tool gripping collar 22, as shown in FIGS. 2 and 3, is a cylindrical collar tip closure cone 50. The collar tip closure cone 50 can be attached by a press or snap fit to the tool gripping collar 22. The closure cone 50 rotates coincident with the rotation of the tool gripping collar 22 and encircles the marking die 46 and the tip aperture 32 of the passageway 30. The closure cone 50 includes an inner annular ledge 52 and protects the marking die 46 when the marking die 46 is withdrawn and is not being used. As shown in FIGS. 2 and 3, a clearance space 54 is defined between the marking die cartridge 44 and the tool gripping collar 22, and disposed within the clearance space 54 is an extension and retraction coil spring 56. Specifically, one end of the coil spring 56 rests upon the inner annular ledge 52 of the collar tip closure cone 50 and the opposite end abuts an outer annular ledge 58 of the marking die cartridge 44. When the marking die 46 is not being used, the marking die 46 is enclosed within and protected by the collar tip closure cone 50, as shown in FIG. 2; when the marking die 46 is disposed in the operative position, as shown in FIG. 3, the marking die 46 extends or projects past the collar tip closure cone 50 for making ink circles 12 around letters—and numbers—of word puzzles as shown on the puzzle 18 of FIG. 4.

Illustrated in FIGS. 2 and 3 is a means for selectively extending or advancing the marking die cartridge 44 and the marking die 46 for using the marking die 46, and for retracting or withdrawing the marking die 46 so that the writing implement 10 has the capability to function as a pen or pencil writing tool. Specifically, the advancing and retracting means includes a pair of cylindrical cams 60 mounted inboard of the tool gripping collar 22 and adjacent the ink reservoir 42 and the marking die cartridge 44. The cams 60 engage and disengage upon rotation of the tool gripping collar 22 for transmitting linear motion to the marking die cartridge 44 so that the marking die 46 can be extended to the operative position. For further explanatory purposes one cam 60 can be denoted the upper, or finger cam, and that cam 60 includes a cam lobe 62, and the other cam 60 can be denoted the lower, or detent cam, and this cam 60 includes a slot 64 on its body to receive the cam lobe 62 of the upper cam 60. The upper cam 60 is connected to the tool gripping collar 22 and rotates coincident with the rotation of the tool gripping collar 22, and the cam 60 denoted the lower cam is connected to the marking die cartridge 44.

FIG. 2 illustrates the writing implement 10 with the marking die 46 in the retracted or withdrawn position so that the ink writing or lead pencil writing function of the writing implement 10 can be employed. (For clarity the ink 38 or pencil cartridges 40 are not shown disposed within the passageway 30 in FIGS. 2 and 3.) The cams 60 are disposed in abutting relationship with each other and the cam lobe 62 of the upper cam 60 is seated within the slot 64 of the lower cam 60 and the marking die 46 is enclosed within and protected by the collar tip closure cone 50. The lower end of the marking die cartridge 44 is also positioned inside the collar tip closure cone 50. When the individual desires to use the marking die 46 to make circular marks around letters, numbers and other symbols, such as encircling indicia 14 of the word puzzle 18 of FIG. 4 as part of the process of solving the word puzzle 18, the individual manually rotates the tool gripping collar 22 thereby causing the coincident rotation of the upper cam 60. The rotation of the upper cam 60 forces the lower cam 60 to separate and advance toward the collar tip closure cone 50. This action causes the marking die cartridge 44 to slide toward the closure cone 50 coincident with the axial advancement of the lower cam 60 with respect to the upper cam 60. This movement of the marking die cartridge 44 causes the marking die 46 to extend past the closure cone 50, as shown in FIGS. 3 and 4, so that the face 48 of the marking die 44 is exposed for use. The marking die cartridge 44 is held in this position under compression by the coil spring 56. Should the individual desire to use the ink pen or lead pencil writing capability of the implement 10, the tool gripping collar 22 can be rotated in the opposite direction thereby causing the cams 60 to be drawn together whereupon the cam lobe 62 seats within the slot 64. Coincident with the retraction of the marking die cartridge 44 is the return of the marking die 46 to the non-use position as shown in FIG. 2. The coil spring 56 extends within the clearance space 54 concomitant with the rotation of the tool gripping collar 22 thereby controlling the retraction of the marking die cartridge 44. Thus, the present invention combines several different writing functions each of which is easy and quick to engage and disengage primarily through the manual rotation feature of the writing implement 10.

Figure 7:
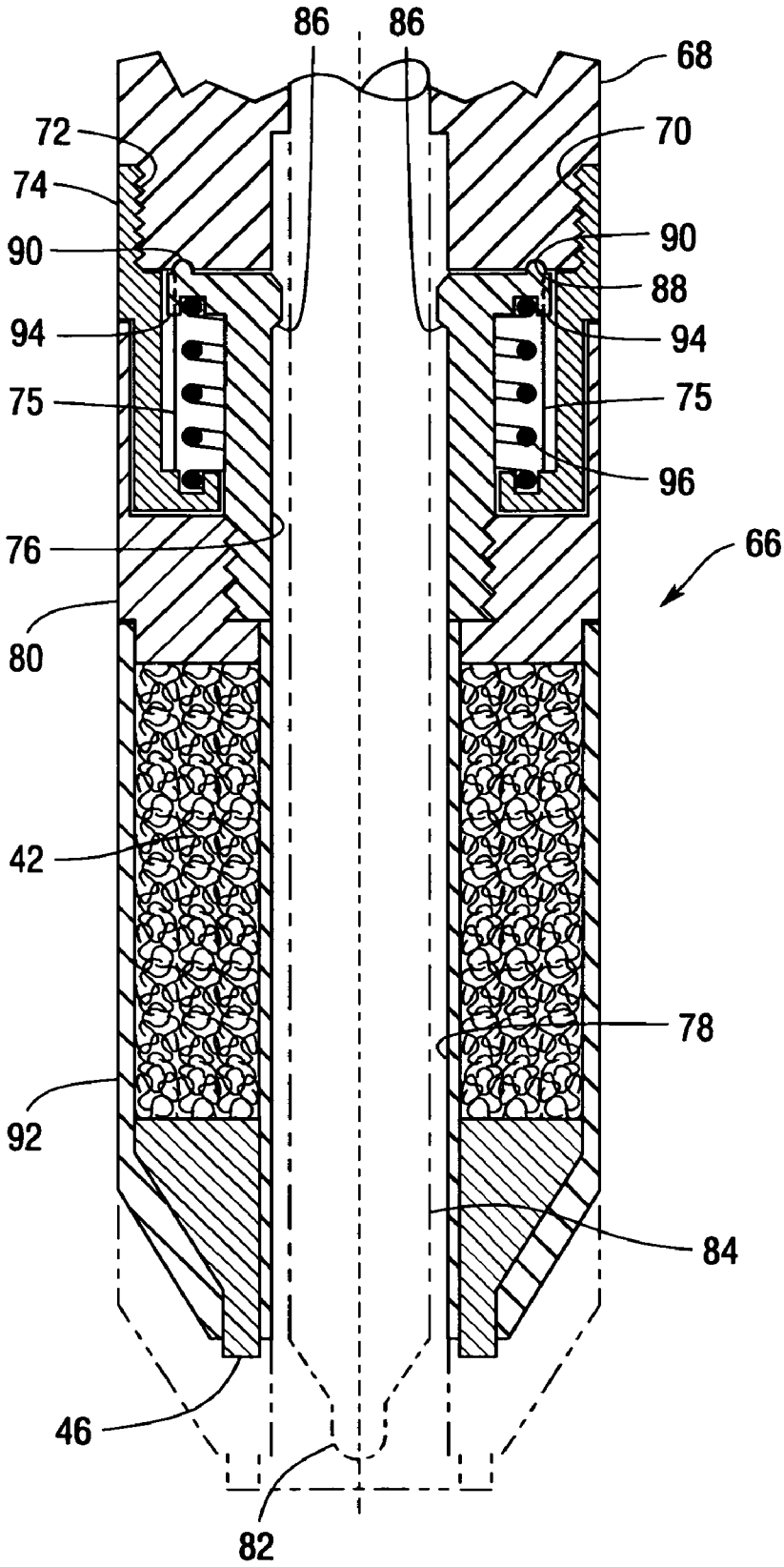
FIG. 7 is a sectioned elevational view of an alternative embodiment of the combination pen or pencil and circular marking implement illustrating a spring-loaded mechanism for changing between the circular marking die and the pen or pencil tip.
Figure 8:
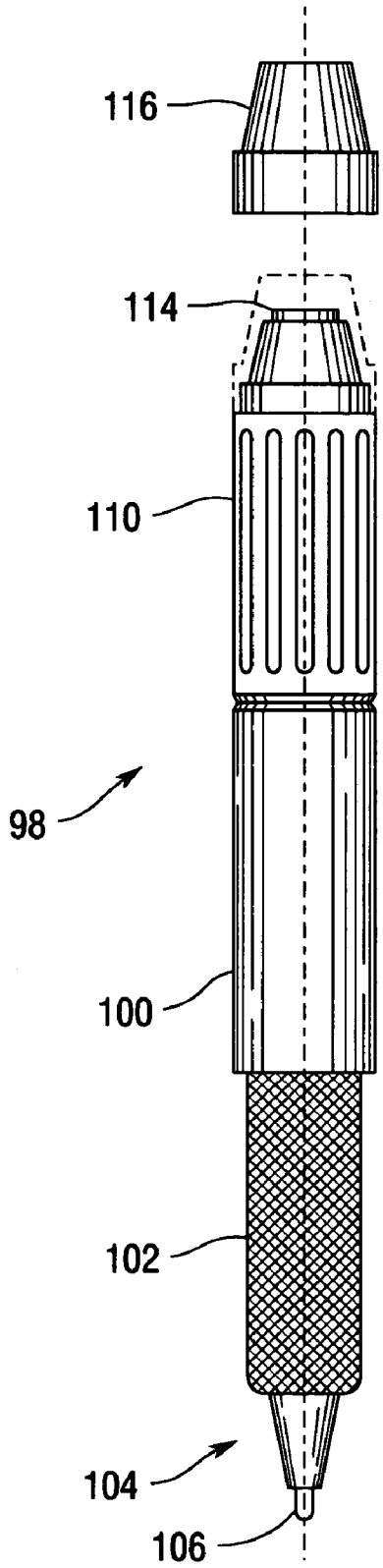
FIG. 8 is an elevational view of an alternative embodiment of the marking implement illustrating the circular marking die located at one end of the implement and a pen/pencil tip located at the opposite end.
Figure 9:
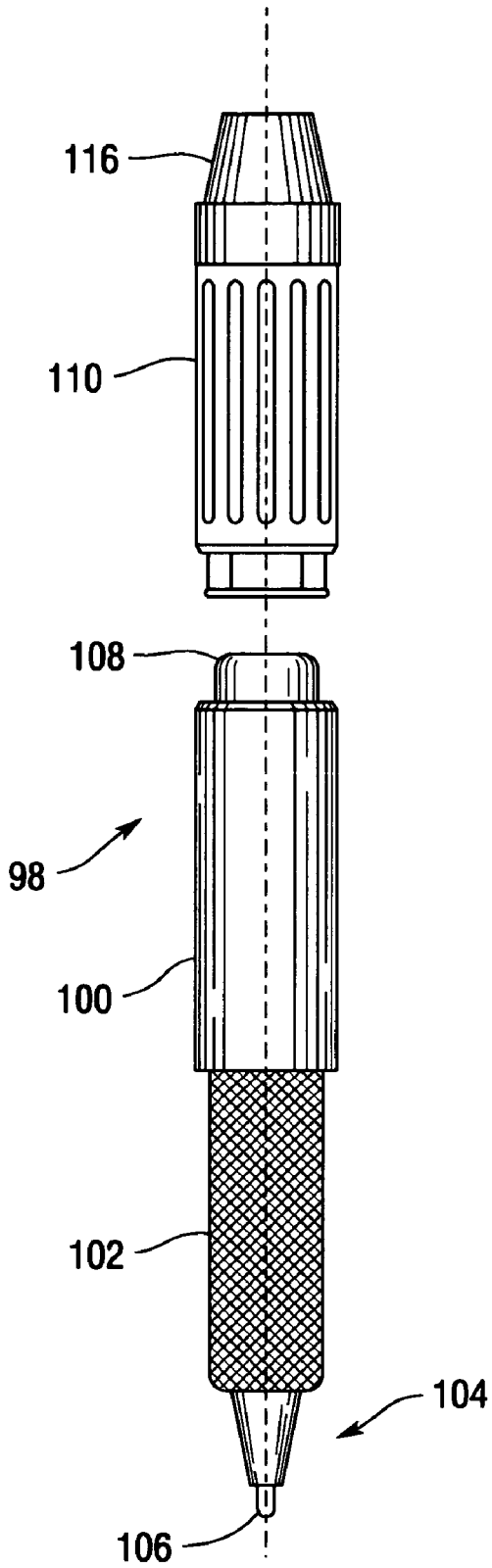
FIG. 9 is an elevational view of the alternative embodiment first shown in FIG. 8 illustrating the removal of the marking die body for the pen/pencil body thereby exposing a replaceable eraser.

Illustrated in FIGS. 7–9 are several alternative embodiments that incorporate many of the above-described features, but also include other features that enhance the flexibility of use of the writing implement 10.

Thus, shown in FIG. 7 is a spring-loaded, press down writing implement 66 that includes a cylindrical body portion 68 having external annular threads 70 that mate with inner annular threads 72 of a cylindrical attachment collar 74. The attachment collar 74 has a stepped shape, and the inside diameter of the attachment collar 74 includes a pair of splines 75 integrally molded to the inside diameter and located 180 degrees from each other on the inside diameter of the collar 74. Disposed inboard of the attachment collar 74 is a cylindrical spring retainer 76. The spring retainer 76 encompasses the passageway 78 of the writing implement 66 and is threaded onto a cylindrical marking die assembly member 80 hereinafter further described.

The spring retainer 76 includes a number of features that facilitate the changeover between the circular marking die 46 and the pen or pencil writing tip 82 (a pen tip and ink holding tube 84 are shown disposed within the passageway 78 in hidden line). The spring retainer 76 includes a plurality of nibs 86 (perhaps two or three) spaced about the inner diameter of the spring retainer 76 for driving and seating the spring retainer 76 to the base of the marking die 46. The spring retainer 76 also includes half-spherical detents 88 molded on to the upper face of the spring retainer 76. The bottom end of the body portion 68 includes an annular detent track and detent pockets 90 spaced 90 degrees from each other and integral with the detent track. The detents 88 travel within the track and set within the pockets 90 to fix the position of the rotatable cylindrical marking die gripping collar 92. The spring retainer 76 also includes a pair of notches 94 that mate with the corresponding splines 75 integrally molded to the interior diameter of the attachment collar 74. The notches 94 mate with the splines 75 when the gripping collar 92 is rotated 90 degrees to an enabling position for extending or retracting the marking die 46. In addition, the spring retainer 76 is keyed to the splines 75 of the attachment collar 74 for allowing the full range of axial extension and retraction when the gripping collar 92 is rotated to the enabling position. Annularly disposed between the spring retainer 76 and the inside diameter of the attachment collar 74 is a marking die retraction spring 96 to control and assist in the retraction and extension of the marking die 46. The passageway 78 defines a clearance extending through the rotatable marking die collar 92 to allow for the axial extension or retraction of the pencil/pen tip 82. The pencil/pen tip 82 is locked to the body portion 68 when either one or the other is extended for use. The marking die assembly 80 includes the gripping collar 92, the ink reservoir 42 and the marking die 46; and these elements extend or retract as one unit when the gripping collar 92 is rotated to the enable position, and the collar 92 is pushed downward to make the circular die mark on the workpiece. When the gripping collar 92 is rotated 90 degrees the splines 75 disengage from the notches 94 and the gripping collar 92 is locked in the retract position, epoxing the pen/pencil tip and disabling the push-down motion of the marking die 46.

The range of extension of the marking die 46 and the gripping collar 92 are shown in hidden line in FIG. 7, and when the marking die 46 is fully extended, the marking die 46 slightly protrudes past the pencil/pen tip 82. The circular marking die 46 is attached to the lower end of the gripping collar 92, and the gripping collar 92 encloses the ink reservoir 42 that is in fluid communication with the marking die 46.

Illustrated in FIGS. 8 and 9 is another alternative embodiment for the writing implement 10 first shown in FIGS. 1–6. FIGS. 8 and 9 illustrate a combination writing implement 98 that includes a cylindrical pen/pencil body 100 to which is secured a cylindrical gripping body 102. The bodies 100 and 102 enclose a passageway (not shown) for receiving an ink tube or pencil cartridges, and the gripping body 102 terminates with a writing end 104 through which a pencil/pen tip 106 can extend for writing or can be withdrawn and retracted therefrom when not in use. The writing implement 98 also includes at its inner end a replaceable pencil/pen eraser 108.

As shown in FIGS. 8 and 9, removably attachable to the inner end of the pen/pencil body 100 is a removable snap fit, or rotatable marking die body 110. The marking die body 110 fits onto the outer end of the pen/pencil body 100 and covers the eraser 108; and the eraser 108 is exposed when the marking die body 110 is lifted off or turned off of the pen/pencil body 100. The marking die body 110 includes at its outer end a circular marking die 114 that is protected by a removable cap 116 that is placed over the marking die 114 to prevent ink dry-out when the marking die 114 is not being used. The marking die body 110 can be selectively rotated or twisted when attached to the pen/pencil body 100, and because the marking die body 110 is interconnected to the gripping body 102, the rotation allows the individual to select the pencil/pin tip 106 for manual writing or marking.

While a particular embodiment has been shown and described, it will be obvious to those skilled in the art that numerous modifications, alterations, and variations are possible and practicable without departing from the spirit of the invention and remaining within the scope of the appended claims.

We claim:

1. A combination pen or pencil and circular marking implement, comprising:

a cylindrical body having a first end and an opposite second writing and marking end;

a passageway extending through the body from the first end to the second end capable of receiving therein ink pen cartridges or pencil leads both of whose tips extend through the passageway adjacent the second end for writing upon and marking unprinted and printed surfaces;

an ink reservoir circumjacent the passageway at the second end;

a cylindrical marking die cartridge circumjacent the ink reservoir at the second end;

a circular marking die tip mounted to the cylindrical marking die cartridge adjacent the second end in flow communication with the ink reservoir and encompassing the passageway;

a cylindrical tool gripping collar mounted to the implement body and encompassing the cylindrical marking die cartridge, the ink reservoir and the passageway adjacent the second end and capable of manual rotatation for advancing the circular marking die cartridge for encircling letters and numbers on the printed surface and for retracting the marking die cartridge so that the ink pen cartridges and pencil leads are used for marking and writing; and a pair of cylindrical cams with one cam attached to the tool gripping collar and the other cam attached to the marking die cartridge so that rotation of the tool gripping collar in one direction causes the cams to close together and withdraw the marking die cartridge and tip while rotation of the tool gripping collar in the other direction causes the cams to separate from each other thereby advancing the marking die cartridge and tip beyond the passageway at the second end so that the marking die cartridge and tip are exposed for making circular ink rings around words and letters on printed surfaces such as alphanumeric puzzles.

2. The combination pen or pencil and circular marking implement of claim 1 further comprising an eraser removably securable to the first end of the body.

3. The combination pen or pencil and circular marking implement of claim 2 further comprising a cap attachable to the first end of the body for covering and uncovering the eraser.

4. The combination pen or pencil and circular marking implement of claim 3 further comprising an extension and retraction spring mounted between the tool gripping collar and the die marking cartridge for facilitating the extension and retraction of the marking die cartridge and the marking die.

5. The combination pen or pencil and circular marking implement of claim 4 further comprising a cylindrical collar tip closure cone mounted to the tool gripping collar for encompassing the marking die cartridge and the passageway adjacent the second end and for protecting the marking die cartridge and tip when the marking die cartridge not in use.

6. A combination writing and marking implement for pen and pencil writing and for circling letters and numbers of an alphanumeric puzzle as part of the solution of the puzzle, comprising:

a cylindrical body;

a tool gripping collar attached to the body and in axial alignment therewith, the tool gripping collar capable of selective rotatable motion;

a tubular passageway extending through the body and the tool gripping collar for receiving therein the pencil leads for writing in pencil and the ink cartridges for writing in ink;

a cylindrical marking die cartridge nested within the tool gripping collar and encompassing the passageway for linear extensible and retractable movement coincident with the rotation of the tool gripping collar;

an ink reservoir nested within the marking die cartridge and encircling the passageway;

a cylindrical marking die mounted to the marking die cartridge for extension and retraction coincident with the extension and retraction of the marking die cartridge upon rotation of the tool gripping collar and in flow communication with the ink reservoir; and a pair of cylindrical cams with one cam attached to the tool gripping collar and the other cam attached to the marking die cartridge so that rotation of the tool gripping collar in one direction draws the cams together and retracts the marking die cartridge and the marking die within the tool gripping collar so that the pencil leads and ink cartridges are used and rotation of the tool gripping collar in the opposite direction forces the cams apart thereby advancing the marking die cartridge and the marking die past the tool gripping collar so that the marking die is used for encircling letters and numbers in ink that are arranged on a printed surface.

7. The combination writing and marking implement of claim 6 further comprising an eraser removably securable to the cylindrical body.

8. The combination writing and marking implement of claim 7 further comprising a cap attachable to the cylindrical body for covering and uncovering the eraser.

9. The combination writing and marking implement of claim 8 further comprising a cylindrical collar tip closure cone mounted to the tool gripping collar for encompassing the marking die when the marking die is in the retracted position and past which the marking die moves when the marking die is advanced for circular marking of letters and numbers on the printed surface.

10. The combination writing and marking implement of claim 9 further comprising an extension and retraction spring disposed between the tool gripping collar and the marking die cartridge for assisting in the retraction and advancement of the marking die cartridge and the marking die.

11. A combination writing and circular marking implement, comprising:

a cylindrical body having a first end and an opposite second end;

a rotatable tool gripping collar mounted to the second end of the cylindrical body in axial alignment therewith;

a tubular passageway extending through the body and the tool gripping collar;

pencil or ink writing means for disposition within the tubular passageway so that the implement is used for writing in pencil or ink;

a cylindrical marking die cartridge nested within the tool gripping collar and encompassing the passageway for selective axial extensible and retractable movement upon actuation by the rotation of the tool gripping collar;

an ink reservoir disposed between the passageway and the marking die cartridge;

a cylindrical marking die mounted to the marking die cartridge in flow communication with the ink reservoir for extension and retraction coincident with the extension and retraction of the marking die cartridge, the marking die capable of making circular ink marks around the letters and numbers of an alphanumeric word puzzle arranged on a printed surface;

a pair of cylindrical cams interconnected to the tool gripping collar and the marking die cartridge so that rotation of the tool gripping collar in one direction draws the cams together and causes the marking die cartridge and the marking die to retract within the tool gripping collar and rotation of the tool gripping collar in the opposite direction forces the cams to separate thereby advancing the marking die cartridge in order for the marking die to freely extend past the tool gripping collar so that the marking die is used for making circular ink marks around the letters and numbers of the alphanumeric word puzzle.

12. The combination writing and circular marking implement of claim 11 further comprising an eraser removably securable at the first end of the cylindrical body.

13. The combination writing and circular marking implement of claim 12 further comprising a cap removably attachable to the first end of the cylindrical body for covering and uncovering the eraser.

14. The combination writing and circular marking implement of claim 13 further comprising a cylindrical collar tip closure cone mounted to the tool gripping collar for encompassing the marking die when the marking die is in the retracted position and past which the marking die extends when the marking die is advanced for making circular ink marks around the letters and numbers of the alphanumeric puzzle.

15. The combination writing and circular marking implement of claim 14 further comprising an extension and retraction spring disposed between the tool gripping collar and the marking die cartridge for assisting in the retraction and advancement of the marking die cartridge and the marking die.

* * * * *